US010777209B1

(12) United States Patent
Ehara et al.

(10) Patent No.: US 10,777,209 B1
(45) Date of Patent: Sep. 15, 2020

(54) CODING APPARATUS AND CODING METHOD

(71) Applicant: Panasonic Intellectual Property Corporation of America, Torrance, CA (US)

(72) Inventors: Hiroyuki Ehara, Kanagawa (JP); Akihisa Kawamura, Osaka (JP); Kai Wu, Singapore (SG); Srikanth Nagisetty, Singapore (SG); Sua Hong Neo, Singapore (SG)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 16/499,935

(22) PCT Filed: Apr. 17, 2018

(86) PCT No.: PCT/JP2018/015790
§ 371 (c)(1),
(2) Date: Oct. 1, 2019

(87) PCT Pub. No.: WO2018/203471
PCT Pub. Date: Nov. 8, 2018

(30) Foreign Application Priority Data

May 1, 2017 (JP) ..... 2017-091412

(51) Int. Cl.
*G10L 19/008* (2013.01)
*H04R 1/40* (2006.01)
*G10L 19/032* (2013.01)

(52) U.S. Cl.
CPC ..... *G10L 19/008* (2013.01); *G10L 19/032* (2013.01); *H04R 1/406* (2013.01)

(58) Field of Classification Search
CPC ..... G10L 19/008; G10L 19/032; H04R 1/406; H04R 1/20; H04R 1/22; H04R 1/222;
(Continued)

(56) References Cited

U.S. PATENT DOCUMENTS 10,152,977 B2 * 12/2018 Atti ..... G10L 25/51
2009/0248425 A1 * 10/2009 Vetterli ..... H04S 3/008 704/503

(Continued)

FOREIGN PATENT DOCUMENTS

JP 2015-171111 9/2015
JP 2015-537256 12/2015
JP 2016-520864 7/2016

OTHER PUBLICATIONS

International Search Report of PCT application No. PCT/JP2018/015790 dated Jul. 10, 2018.

(Continued)

*Primary Examiner* — Norman Yu
(74) *Attorney, Agent, or Firm* — Greenblum & Bernstein, P.L.C.

(57) ABSTRACT

A sound source estimation unit (101) estimates, in a space as a target of sparse sound field decomposition, an area where a sound source is present at second granularity that is coarser than first granularity of a position where a sound source is assumed to be present in the sparse sound field decomposition. A sparse sound field decomposition unit (102) decomposes an acoustic signal observed by a microphone array into a sound source signal and an ambient noise signal by performing a sparse sound field decomposition process at the first granularity for the acoustic signal in the area at the second granularity where the sound source is estimated to be present in the space.

7 Claims, 12 Drawing Sheets

(58) Field of Classification Search
CPC ..... H04R 1/32; H04R 1/326; H04R 21/02; H04R 21/021; H04R 21/023; H04R 21/025; H04R 25/40
USPC ... 381/22, 111, 123, 107, 180, 355, 369, 58, 381/71.1, 71.11
See application file for complete search history.

(56) References Cited

U.S. PATENT DOCUMENTS

2015/0332679 A1* 11/2015 Kruger ..... G10L 19/008 381/23
2016/0088415 A1* 3/2016 Krueger ..... G10L 19/008 381/22

OTHER PUBLICATIONS

Maximo Cobos et al., "A Modified SRP-PHAT Functional for Robust Real-Time Sound Source Localization With Scalable Spatial Sampling", IEEE Signal Processing Letters, vol. 18, No. 1, Jan. 2011, pp. 71-74.
Shoichi Koyama et al., "Analytical Approach to Wave Field Reconstruction Filtering in Spatio-Temporal Frequency Domain", IEEE Transactions on Audio, Speech, and Language Processing, vol. 21, No. 4, Apr. 2013, pp. 685-696.

* cited by examiner

600

CODING APPARATUS AND CODING METHOD

TECHNICAL FIELD

The present disclosure relates to a coding apparatus and a coding method.

BACKGROUND ART

As a wavefield synthesis coding technique, a method has been suggested which performs wavefield synthesis coding in a spatio-temporal frequency domain (for example, see PTL 1).

Further, a method has been suggested which applies a high efficiency coding model which separates and codes a stereophonic sound into a main sound source component and an ambient sound component (for example, see PTL 2) to wavefield synthesis, uses sparse sound field decomposition, thereby separates an acoustic signal observed by a microphone array into a small number of point sound sources (monopole sources) and the residual component other than the point sound sources, and thereby performs the wavefield synthesis (for example, see PTL 3).

CITATION LIST

Patent Literature

PTL 1: U.S. Pat. No. 8,219,409

PTL 2: Japanese Unexamined Patent Application Publication (Translation of PCT Application) No. 2015-537256

PTL 3: Japanese Unexamined Patent Application Publication No. 2015-17111

Non Patent Literature

NPL 1: M. Cobos, A. Marti, anjd J. J. Lopez. "A modified SRP-PHAT functional for robust real-time sound source localization with scalable spatial sampling." IEEE Signal Processing Letters 18.1 (2011): 71-74

NPL 2: Koyama, Shoichi, et al. "Analytical approach to wave field reconstruction filtering in spatio-temporal frequency domain." IEEE Transactions on Audio, Speech, and Language Processing 21.4 (2013): 685-696

SUMMARY OF INVENTION

However, in PTL 1, the computation amount becomes huge because all sound field information is coded. Further, in PTL 3, when the point sound source is extracted by using sparse decomposition, matrix computation is requested, the matrix computation using all positions (grid points (grig points)), in which point sound sources may be present, in a space as an analysis target, and the computation amount thus becomes huge.

One aspect of the present disclosure contributes to provision of a coding apparatus and a coding method that may perform sparse decomposition of a sound field with a low computation amount.

A coding apparatus according to one aspect of the present disclosure employs a configuration that includes: an estimation circuit that estimates, in a space as a target of sparse sound field decomposition, an area where a sound source is present at second granularity which is coarser than first granularity of a position where a sound source is assumed to be present in the sparse sound field decomposition; and a decomposition circuit that decomposes an acoustic signal observed by a microphone array into a sound source signal and an ambient noise signal by performing the sparse sound field decomposition process at the first granularity for the acoustic signal in the area at the second granularity where the sound source is estimated to be present in the space.

A coding method according to one aspect of the present disclosure includes: estimating, in a space as a target of sparse sound field decomposition, an area where a sound source is present at second granularity that is coarser than first granularity of a position where a sound source is assumed to be present in the sparse sound field decomposition; and decomposing an acoustic signal observed by a microphone array into a sound source signal and an ambient noise signal by performing the sparse sound field decomposition process at the first granularity for the acoustic signal in the area at the second granularity where the sound source is estimated to be present in the space.

It should be noted that general or specific aspects may be implemented as a system, a method, an integrated circuit, a computer program, or a recording medium and may be implemented by any combination of systems, apparatuses, methods, integrated circuits, computer programs, and recording media.

In one aspect of the present disclosure, sparse decomposition of a sound field may be performed with a low computation amount.

Further benefits and effects in one aspect of the present disclosure will become apparent from the specification and drawings. Such benefits and/or effects are individually provided by features described in some embodiments, the specification, and the drawings. However, all of them do not necessarily have to be provided in order to obtain one or more same features.

DESCRIPTION OF EMBODIMENTS

Figure 1:
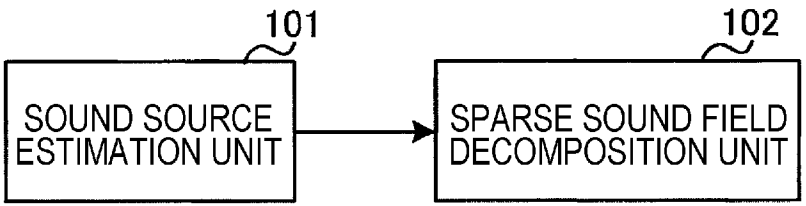
FIG. 1 is a block diagram that illustrates a configuration example of a portion of a coding apparatus according to a first embodiment.

Embodiments of the present disclosure will hereinafter be described in detail with reference to drawings.

Note that in the following, in a coding apparatus, the number of grid points is set to "N", the number of grid points representing positions in which point sound sources are possibly present in a space (sound field) as an analysis target when point sound sources are extracted by sparse decomposition.

Further, the coding apparatus includes a microphone array that includes "M" microphones (not illustrated).

Further, an acoustic signal observed by each microphone is represented as "y" ($\in C^M$). Further, a sound source signal component at each grid point (distribution of monopole sound source components) included in the acoustic signal y is represented as "x" ($\in C^N$), and an ambient noise signal (residual component) as the remaining component other than the sound source signal components is represented as "h" ($\in C^M$).

That is, as represented by the following formula (1), the acoustic signal y is expressed by the sound source signal x and the ambient noise signal h. That is, in the sparse sound field decomposition, the coding apparatus decomposes the acoustic signal y observed by the microphone array into the sound source signal x and the ambient noise signal h.

$$y=Dx+h \tag{1}$$

Note that D ($\in C^{M\times N}$) is an M×N matrix (dictionary matrix) that has a transfer function between each microphone array and each grid point (for example, a Green's function) as an element. For example, in the coding apparatus, a matrix D may be obtained based on the positional relationship between each microphone and each grid point at least before the sparse sound field decomposition.

Here, it is assumed that there is a characteristic (sparsity; sparsity constraint) in which sound source signal components x at most grid points become zero and the sound source signal components x at a small number of grid points become non-zero in a space as a target of the sparse sound field decomposition. For example, in the sparse sound field decomposition, the sound source signal component x that satisfies the reference represented by the following formula (2) is obtained by using the sparsity.

$$\min\|y-Dx\|+\lambda J_{p,q}(x) \tag{2}$$

$$\text{where: } J_{p,q}(x)=\sum_{n=1}^{N}\|x[n]\|_q^p$$

A function $J_{p,q}(x)$ represents a penalty function for causing the sparsity of the sound source signal component x, and λ is a parameter for balancing the penalty with the approximation error.

Note that a specific process of the sparse sound field decomposition in the present disclosure may be performed by using a method disclosed in PTL 3, for example. However, in the present disclosure, the method of the sparse sound field decomposition is not limited to the method disclosed in PTL 3 but may be another method.

Here, in a sparse sound field decomposition algorithm (for example, M-FOCUSS/G-FOCUSS, decomposition based on a minimum norm solution, or the like), because matrix computation is requested, the matrix computation using all grid points in a space as an analysis target (complex matrix computation such as an inverse matrix), the computation amount becomes huge in a case where point sound sources are extracted. Particularly, the dimensions of the vector of the sound source signal component x represented by formula (1) increase as the number N of grid points becomes greater, and the computation amount becomes larger.

Accordingly, in each of the embodiments of the present disclosure, a description will be made about methods for decreasing the computation amount of the sparse sound field decomposition.

First Embodiment

[Outline of Communication System]

A communication system according to this embodiment includes a coding apparatus (encoder) 100 and a decoding apparatus (decoder) 200.

FIG. 1 is a block diagram that illustrates a configuration of a portion of the coding apparatus 100 according to each of the embodiments of the present disclosure. In the coding apparatus 100 illustrated in FIG. 1, a sound source estimation unit 101 estimates an area where a sound source is present at second granularity that is coarser than first granularity of a position where a sound source is assumed to be present in the sparse sound field decomposition in a space as a target of the sparse sound field decomposition. A sparse sound field decomposition unit 102 performs a sparse sound field decomposition process at the first granularity for an acoustic signal observed by a microphone array in an area at the second granularity where a sound source is estimated to be present in the space and thereby decomposes the acoustic signal into a sound source signal and an ambient noise signal.

[Configuration of Coding Apparatus]

Figure 2:
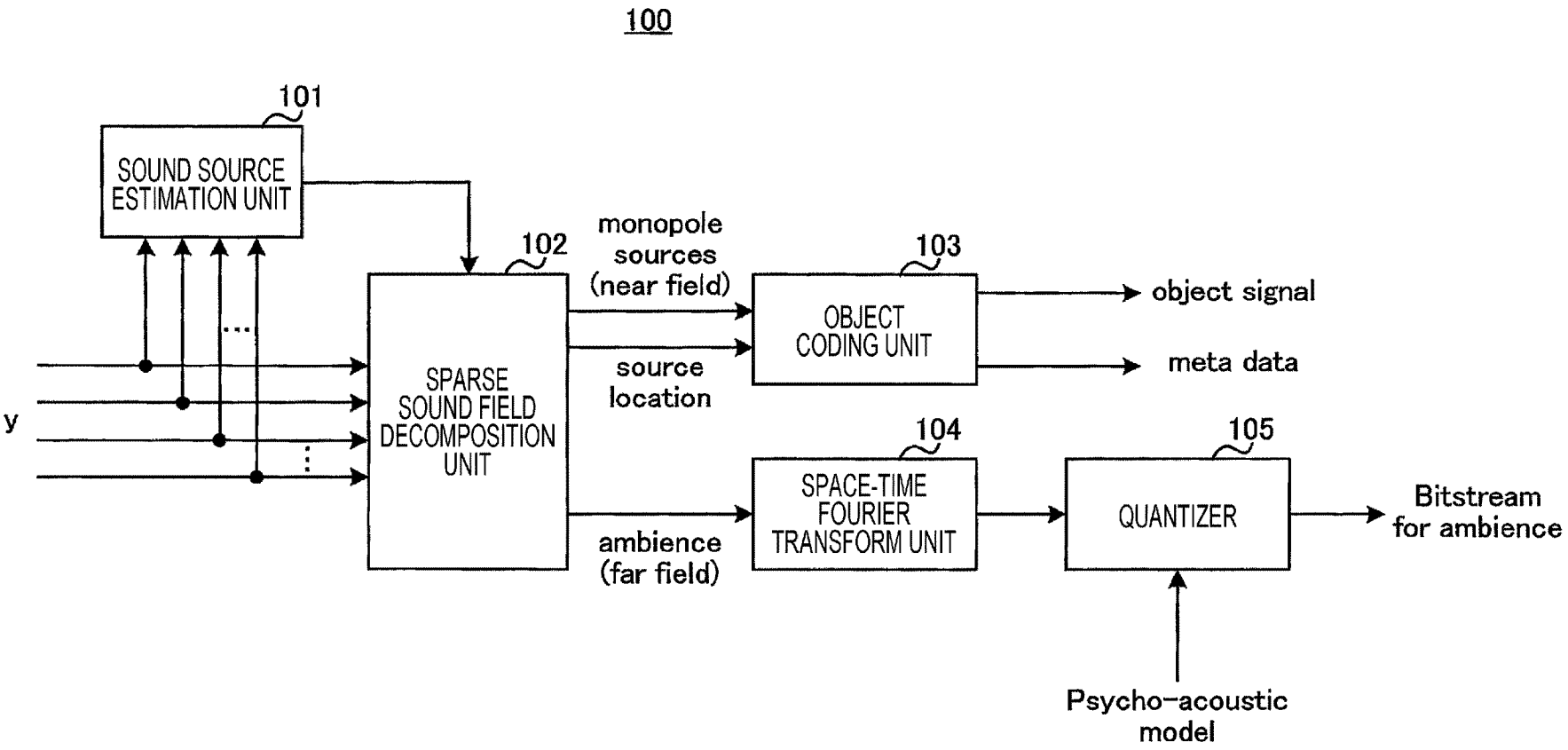
FIG. 2 is a block diagram that illustrates a configuration example of the coding apparatus according to the first embodiment.

FIG. 2 is a block diagram that illustrates a configuration example of the coding apparatus 100 according to this embodiment. In FIG. 2, the coding apparatus 100 employs a configuration that includes the sound source estimation unit 101, the sparse sound field decomposition unit 102, an object coding unit 103, a space-time Fourier transform unit 104, and a quantizer 105.

In FIG. 2, an acoustic signal y is input from the microphone array (not illustrated) of the coding apparatus 100 to the sound source estimation unit 101 and the sparse sound field decomposition unit 102.

The sound source estimation unit 101 analyzes the input acoustic signal y (estimates the sound source) and thereby estimates the area where the sound source is present (the area where the sound source is present with a high probability) (a set of grid points) from a sound field (a space as an analysis target). For example, the sound source estimation unit 101 may use a sound source estimation method that is disclosed in NPL 1 and uses beam forming (BF). Further, the sound source estimation unit 101 performs sound source estimation with coarser grid points (that is, fewer grid points) than N grid points in the space as the analysis target of the sparse sound field decomposition and selects a grid point at which the sound source is present with a high probability (and the periphery). The sound source estimation unit 101 outputs information that indicates the estimated area (the set of grid points) to the sparse sound field decomposition unit 102.

The sparse sound field decomposition unit 102 performs the sparse sound field decomposition for an input acoustic signal in the area where the sound source is estimated to be present, which is indicated by the information input from the sound source estimation unit 101, in the space as the analysis target of the sparse sound field decomposition and thereby decomposes the acoustic signal into the sound source signal x and the ambient noise signal h. The sparse sound field decomposition unit 102 outputs sound source signal components (monopole sources (near field)) to the object coding unit 103 and outputs an ambient noise signal component (ambience (far field)) to the space-time Fourier transform unit 104. Further, the sparse sound field decomposition unit 102 outputs grid point information that indicates the position of the sound source signal (source location) to the object coding unit 103.

The object coding unit 103 codes the sound source signal and the grid point information, which are input from the sparse sound field decomposition unit 102, and outputs a coding result as a set of object data (object signal) and metadata. For example, the object data and the metadata configure an object-coding bitstream (object bitstream). Note that in the object coding unit 103, an existing acoustic coding method may be used for coding an acoustic signal component x. Further, the metadata includes grid point information, which represents the position of the grid point corresponding to the sound source signal, and so forth, for example.

The space-time Fourier transform unit 104 performs space-time Fourier transform for the ambient noise signal input from the sparse sound field decomposition unit 102 and outputs the ambient noise signal (space-time Fourier coefficients or two-dimensional Fourier coefficients), which has been transformed by the space-time Fourier transform, to the quantizer 105. For example, the space-time Fourier transform unit 104 may use two-dimensional Fourier transform disclosed in PTL 1.

The quantizer 105 quantizes and codes the space-time Fourier coefficients input from the space-time Fourier transform unit 104 and outputs those as an ambient-noise-coding bitstream (bitstream for ambience). For example, in the quantizer 105, a quantization coding method (for example, a psycho-acoustic model) disclosed in PTL 1 may be used.

Note that the space-time Fourier transform unit 104 and the quantizer 105 may be referred to as ambient noise coding unit.

The object-coding bitstream and an ambient noise bitstream are multiplexed and transmitted to the decoding apparatus 200, for example (not illustrated).

[Configuration of Decoding Apparatus]

Figure 3:
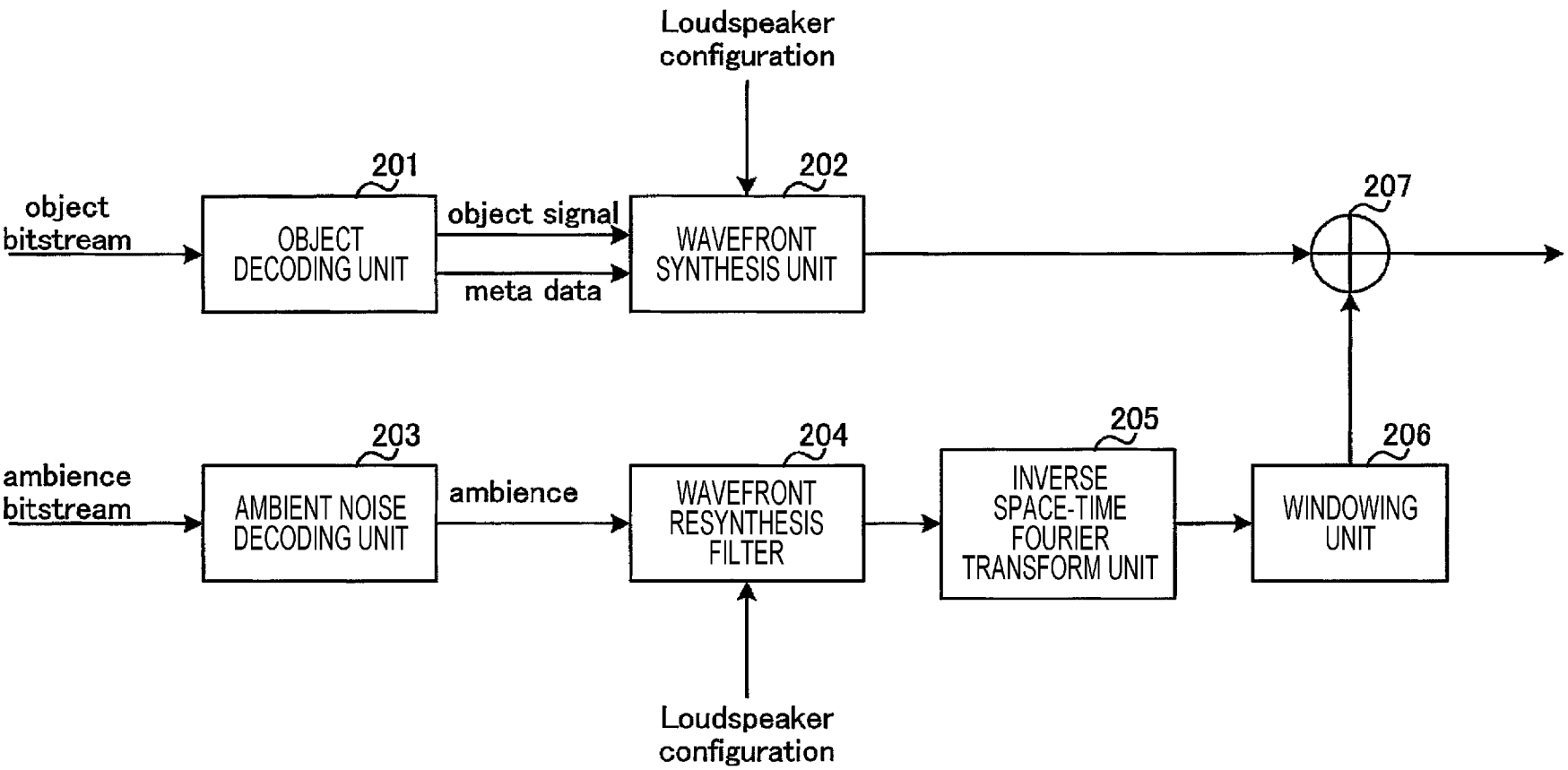
FIG. 3 is a block diagram that illustrates a configuration example of a decoding apparatus according to the first embodiment.

FIG. 3 is a block diagram that illustrates a configuration of the decoding apparatus 200 according to this embodiment. In FIG. 3, the decoding apparatus 200 employs a configuration that includes an object decoding unit 201, a wavefield synthesis unit 202, an ambient noise decoding unit (inverse quantizer) 203, a wavefield resynthesis filter (wavefield reconstruction filter) 204, an inverse space-time Fourier transform unit 205, a windowing unit 206, and an addition unit 207.

In FIG. 3, the decoding apparatus 200 includes a speaker array that is configured with plural speakers (not illustrated). Further, the decoding apparatus 200 receives a signal from the coding apparatus 100 illustrated in FIG. 2 and separates the received signal into the object-coding bitstream (object bitstream) and the ambient-noise-coding bitstream (ambience bitstream) (not illustrated).

The object decoding unit 201 decodes the input object-coding bitstream, separates it into an object signal (sound source signal component) and metadata, and output those to the wavefield synthesis unit 202. Note that the object decoding unit 201 may perform a decoding process by an inverse process to the coding method used in the object coding unit 103 of the coding apparatus 100 illustrated in FIG. 2.

The wavefield synthesis unit 202 uses the object signal and the metadata, which are input from the object decoding unit 201, and speaker arrangement information (loudspeaker configuration) that is separately input or set, thereby obtains an output signal from each speaker of the speaker array, and outputs the obtained output signal to an adder 207. Note that as a generation method of the output signal in the wavefield synthesis unit 202, for example, a method disclosed in PTL 3 may be used.

The ambient noise decoding unit 203 decodes two-dimensional Fourier coefficients included in the ambient-noise-coding bitstream and outputs a decoded ambient noise signal component (ambience; for example, two-dimensional Fourier coefficients) to the wavefield resynthesis filter 204. Note that the ambient noise decoding unit 203 may perform a decoding process by an inverse process to the coding process in the quantizer 105 of the coding apparatus 100 illustrated in FIG. 2.

The wavefield resynthesis filter 204 uses the ambient noise signal component input from the ambient noise decoding unit 203 and the speaker arrangement information (loudspeaker configuration) that is separately input or set, thereby transforms the acoustic signal collected by the microphone array of the coding apparatus 100 into a signal to be output from the speaker array of the decoding apparatus 200, and outputs the transformed signal to the inverse space-time Fourier transform unit 205. Note that as a generation method of the output signal in the wavefield resynthesis filter 204, for example, a method disclosed in PTL 3 may be used.

The inverse space-time Fourier transform unit 205 performs inverse space-time Fourier transform for the signal input from the wavefield resynthesis filter 204 and transforms the signal into a time signal (ambient noise signal) to be output from each speaker of the speaker array. The inverse space-time Fourier transform unit 205 outputs the time signal to the windowing unit 206. Note that as a transform process in the inverse space-time Fourier transform unit 205, for example, a method disclosed in PTL 1 may be used.

The windowing unit 206 conducts a windowing process (tapering windowing) for the time signal (ambient noise signal), which is input from the inverse space-time Fourier transform unit 205 and is to be output from each speaker, and thereby smoothly connects signals among frames. The windowing unit 206 outputs the signal, for which the windowing process has been conducted, to the adder 207.

The adder 207 adds the sound source signal input from the wavefield synthesis unit 202 to the ambient noise signal input from the windowing unit 206 and outputs the added signal as a final decoded signal to each speaker.

[Action of Coding Apparatus 100]

A detailed description will be made about an action in the coding apparatus 100 that has the above configuration.

Figure 4:
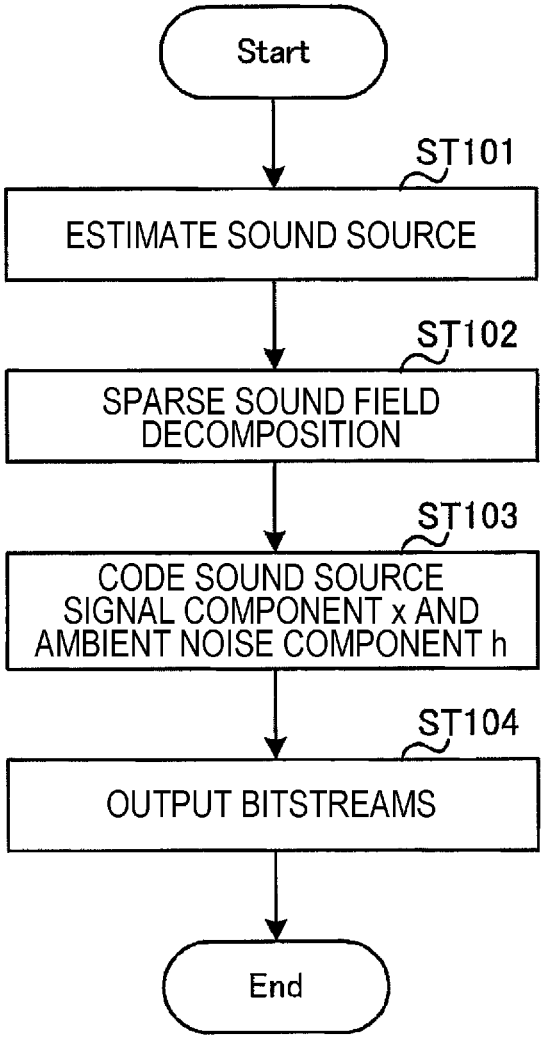
FIG. 4 is a flowchart that illustrates a flow of a process of the coding apparatus according to the first embodiment.

FIG. 4 is a flowchart that illustrates a flow of a process of the coding apparatus 100 according to this embodiment.

First, in the coding apparatus 100, the sound source estimation unit 101 estimates an area where the sound source is present in the sound field by using a method based on beam forming, which is disclosed in NPL 1, for example (ST101). Here, the sound source estimation unit 101 estimates (identifies) the area (coarse area) where the sound source is present at coarser granularity than the granularity of the grid point (position) at which the sound source is assumed to be present in the sparse sound field decomposition in a space as an analysis target of sparse decomposition.

Figure 5:
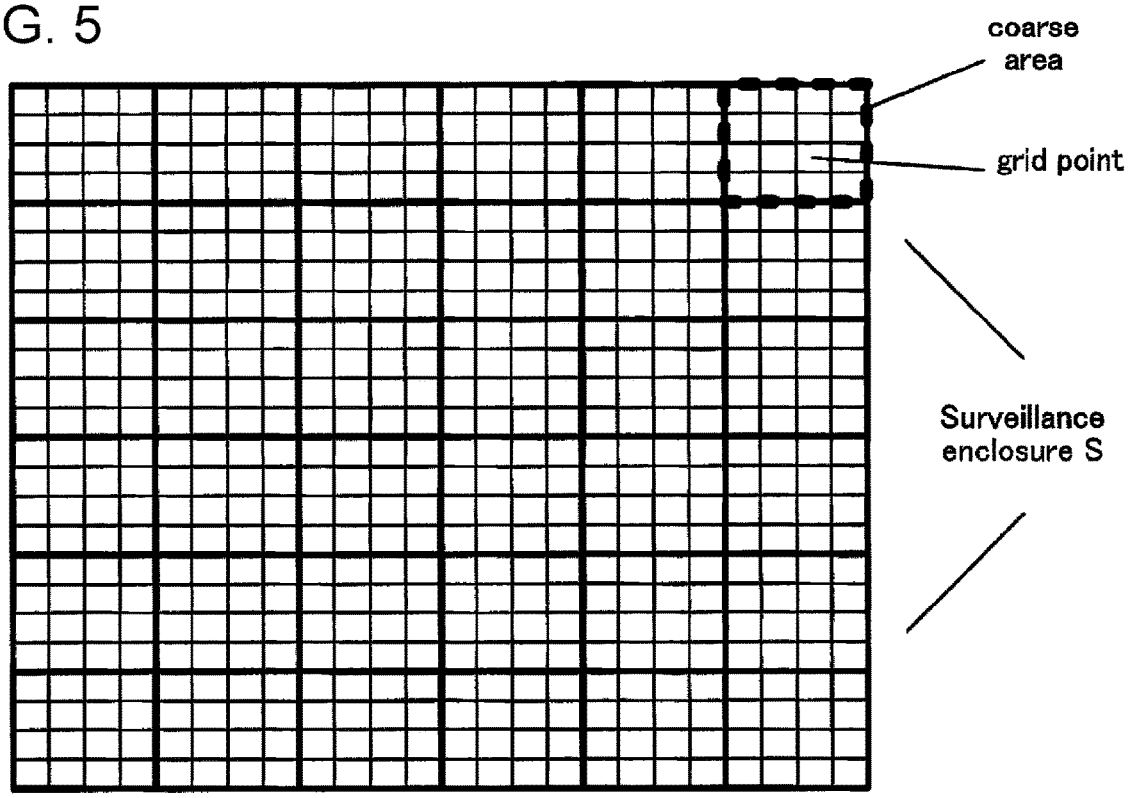
FIG. 5 is a diagram for an explanation about a sound source estimation process and a sparse sound field decomposition process according to the first embodiment.

FIG. 5 illustrates one example of a space S (surveillance enclosure) (that is, an observation area of the sound field) formed with grid points as analysis targets of the sparse decomposition (that is, which correspond to the sound source signal components x). Note that FIG. 5 illustrates the space S two-dimensionally, but the actual space may be three-dimensional.

The sparse sound field decomposition separates the acoustic signal y into the sound source signal x and the ambient noise signal h while each of the grid points illustrated in FIG. 5 is set as a unit. Meanwhile, as illustrated in FIG. 5, the area (coarse area) as a target of sound source estimation by the sound source estimation unit 101 by beam forming is represented as a coarser area than the grid point of the sparse decomposition. That is, the area as the target of the sound source estimation is represented by plural grid points of the sparse sound field decomposition. In other words, the sound source estimation unit 101 estimates the position where the sound source is present at coarser granularity than the granularity at which the sparse sound field decomposition unit 102 extracts the sound source signal x.

Figure 6:
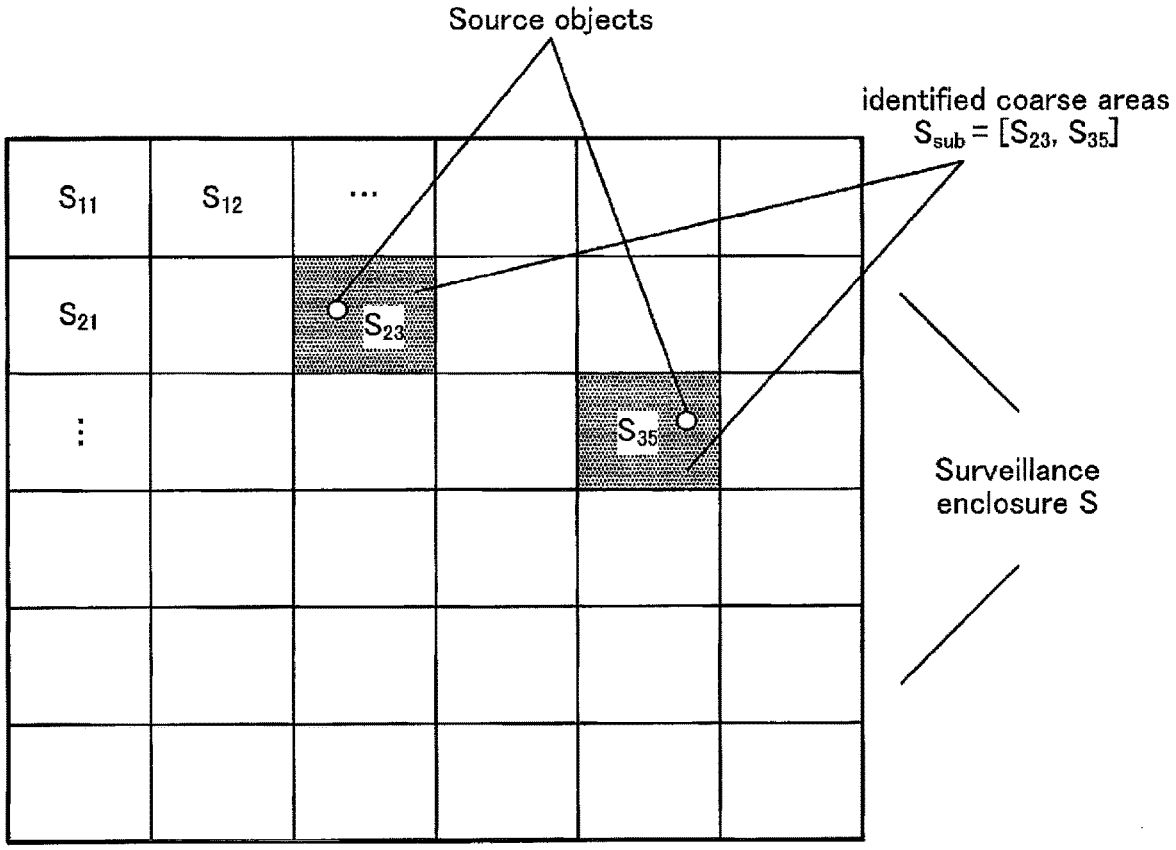
FIG. 6 is a diagram for an explanation about the sound source estimation process according to the first embodiment.

FIG. 6 illustrates examples of areas (identified coarse areas) that are identified as the areas where the sound sources are present in the space S illustrated in FIG. 5 by the sound source estimation unit 101. In FIG. 6, for example, it is assumed that the energy of areas (coarse areas) of $S_{23}$ and $S_{35}$ is higher than the energy of the other areas. In this case, the sound source estimation unit 101 identifies $S_{23}$ and $S_{35}$ as a set $S_{sub}$ of areas where sound sources (source objects) are present.

Figure 7:
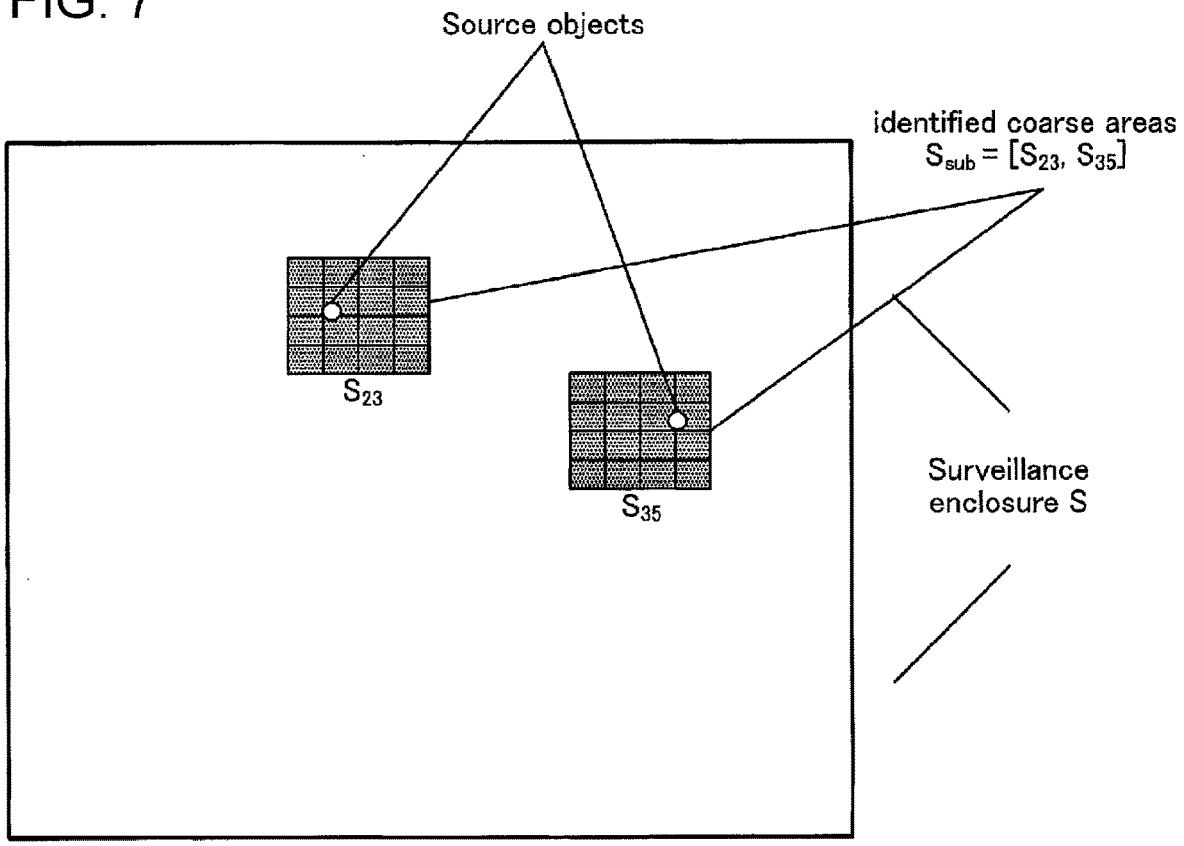
FIG. 7 is a diagram for an explanation about the sparse sound field decomposition process according to the first embodiment.

Next, the sparse sound field decomposition unit 102 performs the sparse sound field decomposition for the grid points in the areas where the sound sources are estimated to be present by the sound source estimation unit 101 (ST102). For example, in a case where the areas illustrated in FIG. 6 ($S_{sub}=[S_{23}, S_{35}]$) are identified by the sound source estimation unit 101, as illustrated in FIG. 7, the sparse sound field decomposition unit 102 performs the sparse sound field decomposition for the grid points of the sparse sound field decomposition in the identified areas ($S_{sub}=[S_{23}, S_{35}]$).

For example, the sound source signals x that correspond to plural grid points in the area $S_{sub}$ identified by the sound field estimation unit 101 are represented as "$x_{sub}$". The matrix, which is formed with the elements corresponding to the relationships between the plural grid points in $S_{sub}$ and plural microphones of the coding apparatus 100, in a matrix D (M×N) is represented as "$D_{sub}$".

In this case, the sparse sound field decomposition unit 102 decomposes the acoustic signal y observed by each microphone into a sound source signal $x_{sub}$ and the ambient noise signal h as the following formula (3).

$$y=D_{sub}x_{sub}+h \tag{3}$$

Then, the coding apparatus 100 (the object coding unit 103, the space-time Fourier transform unit 104, and the quantizer 105) codes the sound source signal $x_{sub}$ and the ambient noise signal h (ST103) and outputs the obtained bitstreams (the object-coding bitstream and the ambient-noise-coding bitstream) (ST104). Those signals are transmitted to the decoding apparatus 200 side.

In such a manner, in this embodiment, in the coding apparatus 100, the sound source estimation unit 101 estimates the area where the sound source is present at coarser granularity (second granularity) than the granularity (first granularity) of the grid point that indicates the position where the sound source is assumed to be present in the sparse sound field decomposition in the space as the target of the sparse sound field decomposition. Then, the sparse sound field decomposition unit 102 performs the sparse sound field decomposition process at the first granularity for the acoustic signal y observed by the microphone array in the area (coarse area) at the second granularity where the sound source is estimated to be present in the space and thereby decomposes the acoustic signal y into the sound source signal x and the ambient noise signal h.

That is, the coding apparatus 100 preliminarily searches for an area where the sound source is present with a high probability and limits the analysis target of the sparse sound field decomposition to the searched area. In other words, the coding apparatus 100 limits the application range of the sparse sound field decomposition to the grid points around where the sound source is present among all the grid points.

As described above, it is assumed that a small number of sound sources are present in the sound field. Accordingly, in the coding apparatus 100, the area as the analysis target of the sparse sound field decomposition is limited to a narrower area. Thus, the computation amount of the sparse sound field decomposition process may significantly be reduced compared to a case where the sparse sound field decomposition process is performed for all the grid points.

Figure 8:
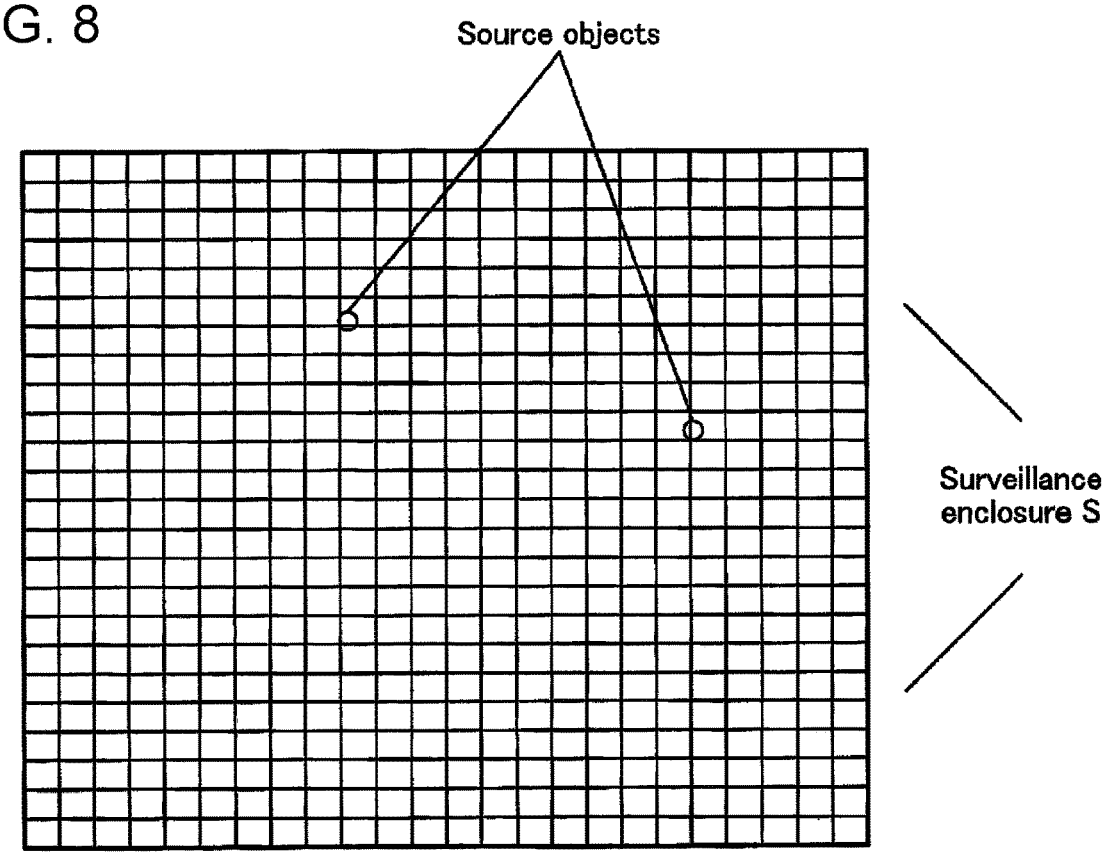
FIG. 8 is a diagram for an explanation about a case where the sparse sound field decomposition process is performed for a whole space of a sound field.

For example, FIG. 8 illustrates a situation of a case where the sparse sound field decomposition is performed for all the grid points. In FIG. 8, two sound sources are present in similar positions to FIG. 6. In FIG. 8, for example, as a method disclosed in PTL 3, in the sparse sound field decomposition, matrix computation which uses all the grid points in the space as the analysis target is requested. However, as illustrated in FIG. 7, the area as the analysis target of the sparse sound field decomposition of this embodiment is reduced to $S_{sub}$. Thus, in the sparse sound field decomposition unit 102, the vector of the sound source signal $x_{sub}$ has less dimensions, and the matrix computation amount for the matrix $D_{sub}$ is thus reduced.

Accordingly, in this embodiment, the sparse decomposition of a sound field may be performed with a low computation amount.

Further, for example, as illustrated in FIG. 7, the underdetermined condition is mitigated by reduction in the number of columns of the matrix $D_{sub}$, and the performance of the sparse sound field decomposition may thus be improved.

Second Embodiment

[Configuration of Coding Apparatus]

Figure 9:
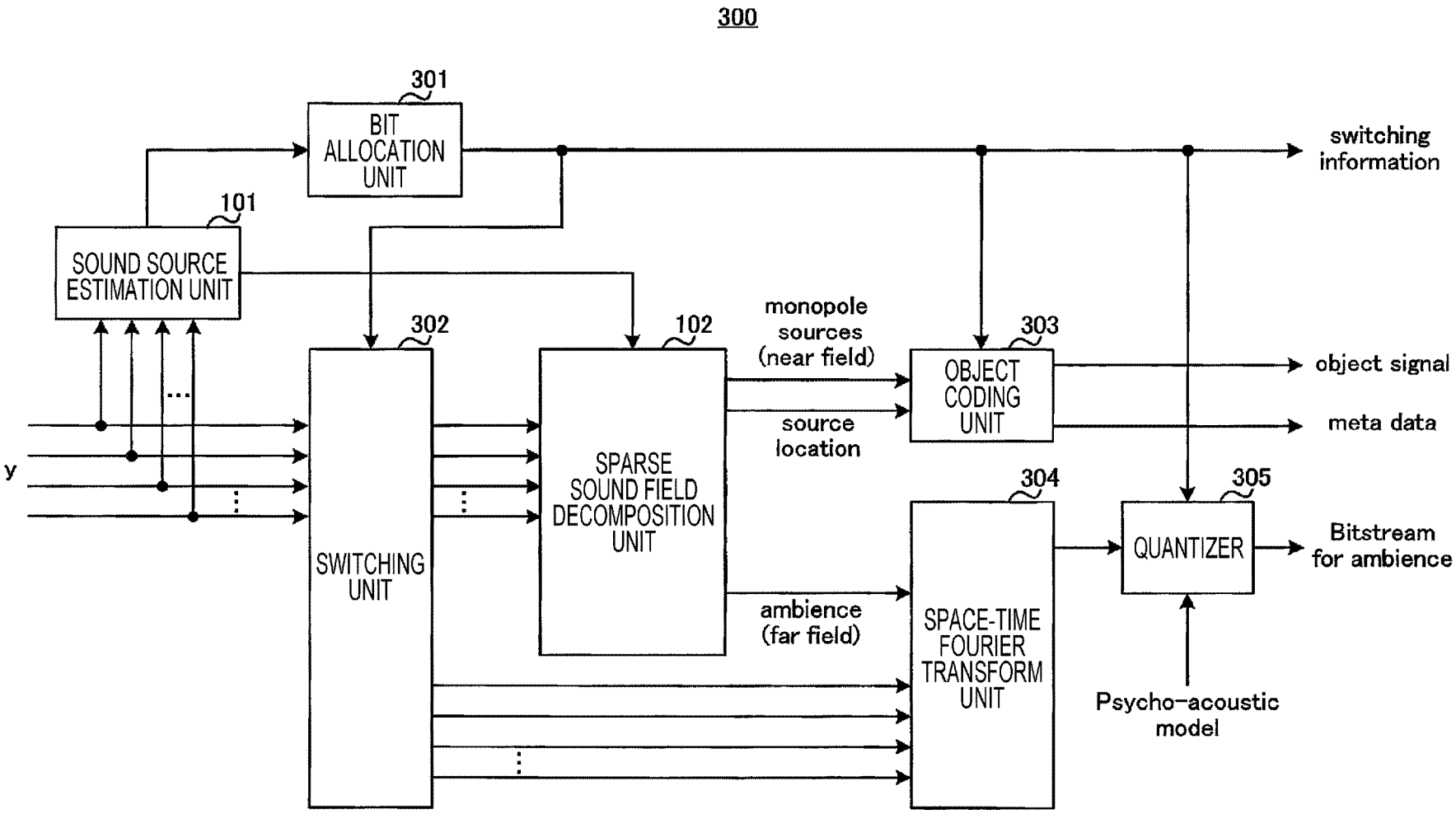
FIG. 9 is a block diagram that illustrates a configuration example of a coding apparatus according to a second embodiment.

FIG. 9 is a block diagram that illustrates a configuration of a coding apparatus 300 according to this embodiment.

Note that in FIG. 9, the same reference numerals are given to similar configurations to the first embodiment (FIG. 2), and descriptions thereof will not be made. Specifically, the coding apparatus 300 illustrated in FIG. 9 additionally includes a bit allocation unit 301 and a switching unit 302 compared to the configuration of the first embodiment (FIG. 2).

Information that indicates the number of sound sources estimated to be present in the sound field (that is, the number of areas (coarse areas) where the sound sources are estimated to be present) is input from the sound source estimation unit 101 to the bit allocation unit 301.

The bit allocation unit 301 determines, based on the number of sound sources estimated by the sound source estimation unit 101, which of a mode in which the sparse sound field decomposition similar to the first embodiment is performed and a mode in which a spatio-temporal spectrum coding disclosed in PTL 1 is performed is applied. For example, the bit allocation unit 301 determines to apply the mode in which the sparse sound field decomposition is performed in a case where the estimated number of sound sources is a prescribed number (threshold value) or less and determines to apply the mode in which the sparse sound field decomposition is not performed but the spatio-temporal spectrum coding is performed in a case where the estimated number of sound sources exceeds the prescribed number.

Here, the prescribed number may be the number of sound sources at which the coding performance by the sparse sound field decomposition may not sufficiently be obtained (that is, the number of sound sources at which sparsity may not be obtained), for example. Further, in a case where the bit rate of the bitstream is defined, the prescribed number may be the upper limit value of the number of objects that may be transmitted at the bit rate.

The bit allocation unit 301 outputs switching information that indicates the determined mode to the switching unit 302, an object coding unit 303, and a quantizer 305. Further, the switching information is transmitted together with the object-coding bitstream and the ambient-noise-coding bitstream to a decoding apparatus 400 (which will be described later) (not illustrated).

Note that the switching information is not limited to the determined mode but may be information that indicates the bit allocations to the object-coding bitstream and the ambient-noise-coding bitstream. For example, the switching information may indicate the number of bits assigned to the object-coding bitstream in the mode in which the sparse sound field decomposition is applied and may indicate that the number of bits assigned to the object-coding bitstream is zero in the mode in which the sparse sound field decomposition is not applied. Alternatively, the switching information may indicate the number of bits of the ambient-noise-coding bitstream.

The switching unit 302 switches output destinations of the acoustic signal y, corresponding to the coding mode, in accordance with the switching information (mode information or bit allocation information) input from the bit allocation unit 301. Specifically, the switching unit 302 outputs the acoustic signal y to the sparse sound field decomposition unit 102 in a case of the mode in which the sparse sound field decomposition similar to the first embodiment is applied. On the other hand, the switching unit 302 outputs the acoustic signal y to a space-time Fourier transform unit 304 in a case of the mode in which the spatio-temporal spectrum coding is performed.

In the case of the mode in which the sparse sound field decomposition is performed (for example, a case where the estimated number of sound sources is the threshold value or less), the object coding unit 303 performs object coding for the sound source signal similarly to the first embodiment in accordance with the switching information input from the bit allocation unit 301. On the other hand, the object coding unit 303 does not perform coding in the case of the mode in which the spatio-temporal spectrum coding is performed (for example, a case where the estimated number of sound sources exceeds the threshold value).

The space-time Fourier transform unit 304 performs space-time Fourier transform for the ambient noise signal h input from the sparse sound field decomposition unit 102 in the case of the mode in which the sparse sound field decomposition is performed or performs space-time Fourier transform for the acoustic signal y input from the switching unit 302 in the case of the mode in which the spatio-temporal spectrum coding is performed and outputs the signal (two-dimensional Fourier coefficients), which has been transformed by the space-time Fourier transform, to the quantizer 305.

In the case of the mode in which the sparse sound field decomposition is performed, the quantizer 305 performs quantization coding of the two-dimensional Fourier coefficients similarly to the first embodiment in accordance with the switching information input from the bit allocation unit 301. On the other hand, the quantizer 305 performs quantization coding of the two-dimensional Fourier coefficients similarly to PTL 1 in the case of the mode in which the spatio-temporal spectrum coding is performed.

[Configuration of Decoding Apparatus]

Figure 10:
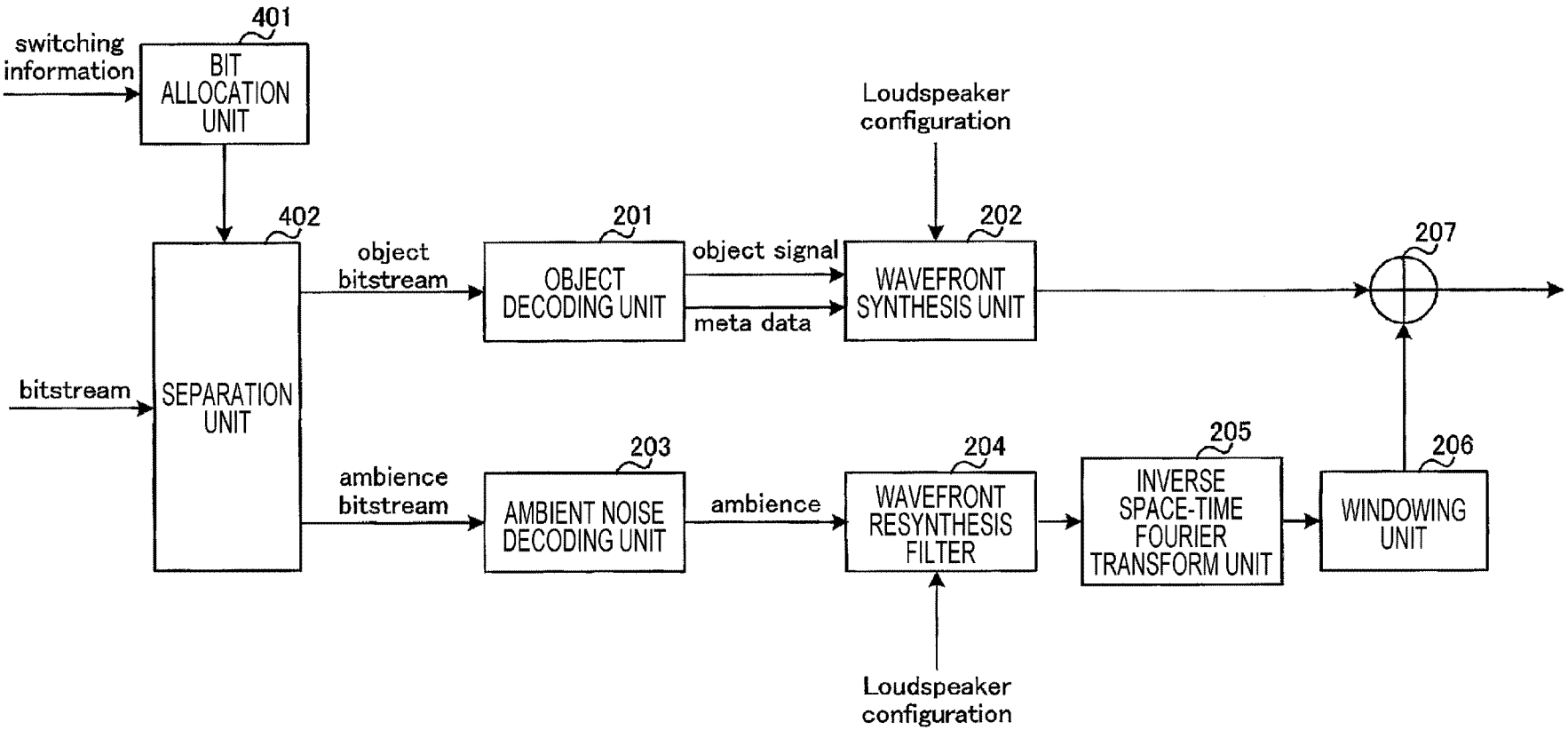
FIG. 10 is a block diagram that illustrates a configuration example of a decoding apparatus according to the second embodiment.

FIG. 10 is a block diagram that illustrates a configuration of the decoding apparatus 400 according to this embodiment.

Note that in FIG. 10, the same reference numerals are given to similar configurations to the first embodiment (FIG. 3), and descriptions thereof will not be made. Specifically, the decoding apparatus 400 illustrated in FIG. 10 additionally includes a bit allocation unit 401 and a separation unit 402 compared to the configuration of the first embodiment (FIG. 3).

The decoding apparatus 400 receives a signal from the coding apparatus 300 illustrated in FIG. 9, outputs the switching information to the bit allocation unit 401, and outputs the other bitstreams to the separation unit 402.

The bit allocation unit 401 determines the bit allocations to the object-coding bitstream and the ambient-noise-coding bitstream in the received bitstreams based on the input switching information and outputs the determined bit allocation information to the separation unit 402. Specifically, in a case where the sparse sound field decomposition is performed by the coding apparatus 300, the bit allocation unit 401 determines the numbers of bits that are each allocated to the object-coding bitstream and the ambient-noise-coding bitstream. On the other hand, in a case where the spatio-temporal spectrum coding is performed by the coding apparatus 300, the bit allocation unit 401 does not allocate bits to the object-coding bitstream but allocates bits to the ambient-noise-coding bitstream.

The separation unit 402 separates the input bitstream into the bitstreams of various kinds of parameters in accordance with the bit allocation information input from the bit allocation unit 401. Specifically, in a case where the sparse sound field decomposition is performed by the coding apparatus 300, the separation unit 402 separates the bitstream into the object-coding bitstream and the ambient-noise-coding bitstream similarly to the first embodiment and respectively outputs those to the object decoding unit 201 and the ambient noise decoding unit 203. On the other hand, in a case where the spatio-temporal spectrum coding is performed by the coding apparatus 300, the separation unit 402 outputs the input bitstream to the ambient noise decoding unit 203 and outputs nothing to the object decoding unit 201.

In such a manner, in this embodiment, the coding apparatus 300 determines whether or not the sparse sound field decomposition described in the first embodiment is applied in accordance with the number of sound sources estimated in the sound source estimation unit 101.

As described above, because it is assumed that the sparsity of sound sources in the sound field is present in the sparse sound field decomposition, a circumstance in which the number of sound sources is large may not be optimal as an analysis model of the sparse sound field decomposition. That is, when the number of sound sources becomes large, the sparsity of sound sources in the sound field lowers. In a case where the sparse sound field decomposition is applied, it is possible that the expressiveness or decomposition performance of the analysis model is lowered.

However, the coding apparatus 300 performs spatio-temporal spectrum coding as described in PTL 1, for example, in a case where the number of sound fields becomes large (the sparsity becomes low) and proper coding performance may not be obtained by the sparse sound field decomposition. Note that the coding model for a case where the number of sound fields is large is not limited to spatio-temporal spectrum coding as described in PTL 1.

In such a manner, in this embodiment, the coding models may flexibly be switched in accordance with the number of sound sources, and highly efficient coding may thus be realized.

Note that positional information of the estimated sound sources may be input from the sound source estimation unit 101 to the bit allocation unit 301. For example, the bit allocation unit 301 may set the bit allocations to the sound source signal component x and the ambient noise signal h (or a threshold value of the number of sound sources) based on the positional information of the sound sources. For example, the bit allocation unit 301 may make the bit allocation to the sound source signal component x more as the position of the sound source is a closer position to a front position to the microphone array.

Third Embodiment

A decoding apparatus according to this embodiment has a basic configuration common to the decoding apparatus 400 according to the second embodiment and will thus be described making reference to FIG. 10.

[Configuration of Coding Apparatus]

Figure 11:
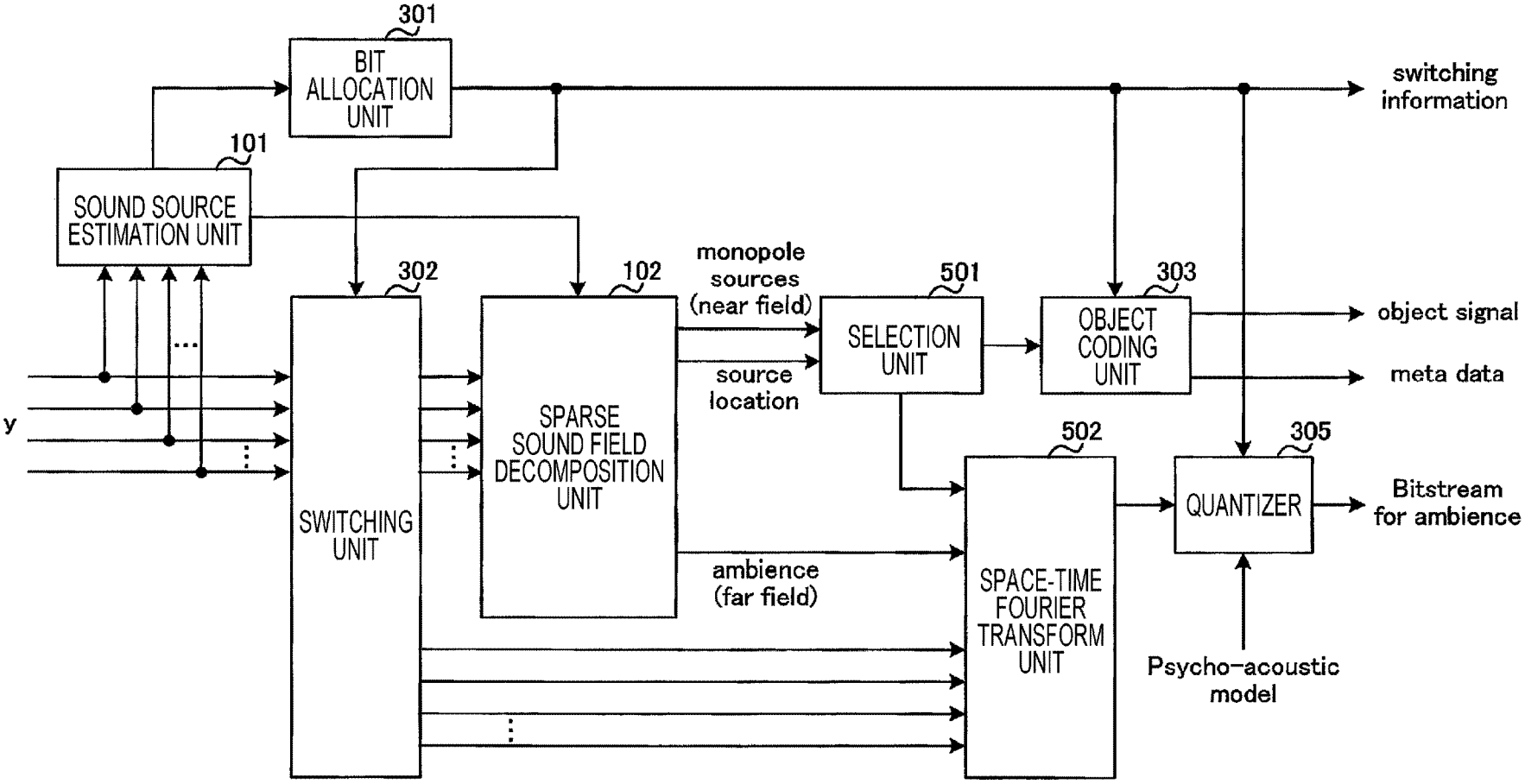
FIG. 11 is a block diagram that illustrates a configuration example of a coding apparatus according to a third embodiment.

FIG. 11 is a block diagram that illustrates a configuration of a coding apparatus 500 according to this embodiment.

Note that in FIG. 11, the same reference numerals are given to similar configurations to the second embodiment (FIG. 9), and descriptions thereof will not be made. Specifically, the coding apparatus 500 illustrated in FIG. 11 additionally includes a selection unit 501 compared to the configuration of the second embodiment (FIG. 9).

The selection unit 501 selects main sound sources (for example, a prescribed number of sound sources in descending order of energy), which are a portion of the sound source signals x (sparse sound sources) input from the sparse sound field decomposition unit 102. Then, the selection unit 501 outputs the selected sound source signals as object signals (monopole sources) to the object coding unit 303 and outputs the remaining sound source signals, which are not selected, as the ambient noise signal (ambience) to a space-time Fourier transform unit 502.

That is, the selection unit 501 recategorizes a portion of the sound source signals x, which are generated (extracted) by the sparse sound field decomposition unit 102, as the ambient noise signal h.

In a case where the sparse sound field decomposition is performed, the space-time Fourier transform unit 502 performs the spatio-temporal spectrum coding for the ambient noise signal h input from the sparse sound field decomposition unit 102 and the ambient noise signal h (the recategorized sound source signal) input from the selection unit 501.

In such a manner, in this embodiment, the coding apparatus 500 selects main components of the sound source signals extracted by the sparse sound field decomposition unit 102, performs object coding, and may thereby secure bit allocations to more important objects even in a case where the number of bits available for object coding is limited. Accordingly, general coding performance by the sparse sound field decomposition may be improved.

Fourth Embodiment

In this embodiment, a method will be described in which the bit allocations to the sound source signal x obtained by the sparse sound field decomposition and the ambient noise signal h are set in accordance with the energy of the ambient noise signal.

[Method 1]

A decoding apparatus according to method 1 of this embodiment has a basic configuration common to the decoding apparatus 400 according to the second embodiment and will thus be described making reference to FIG. 10.

[Configuration of Coding Apparatus]

Figure 12:
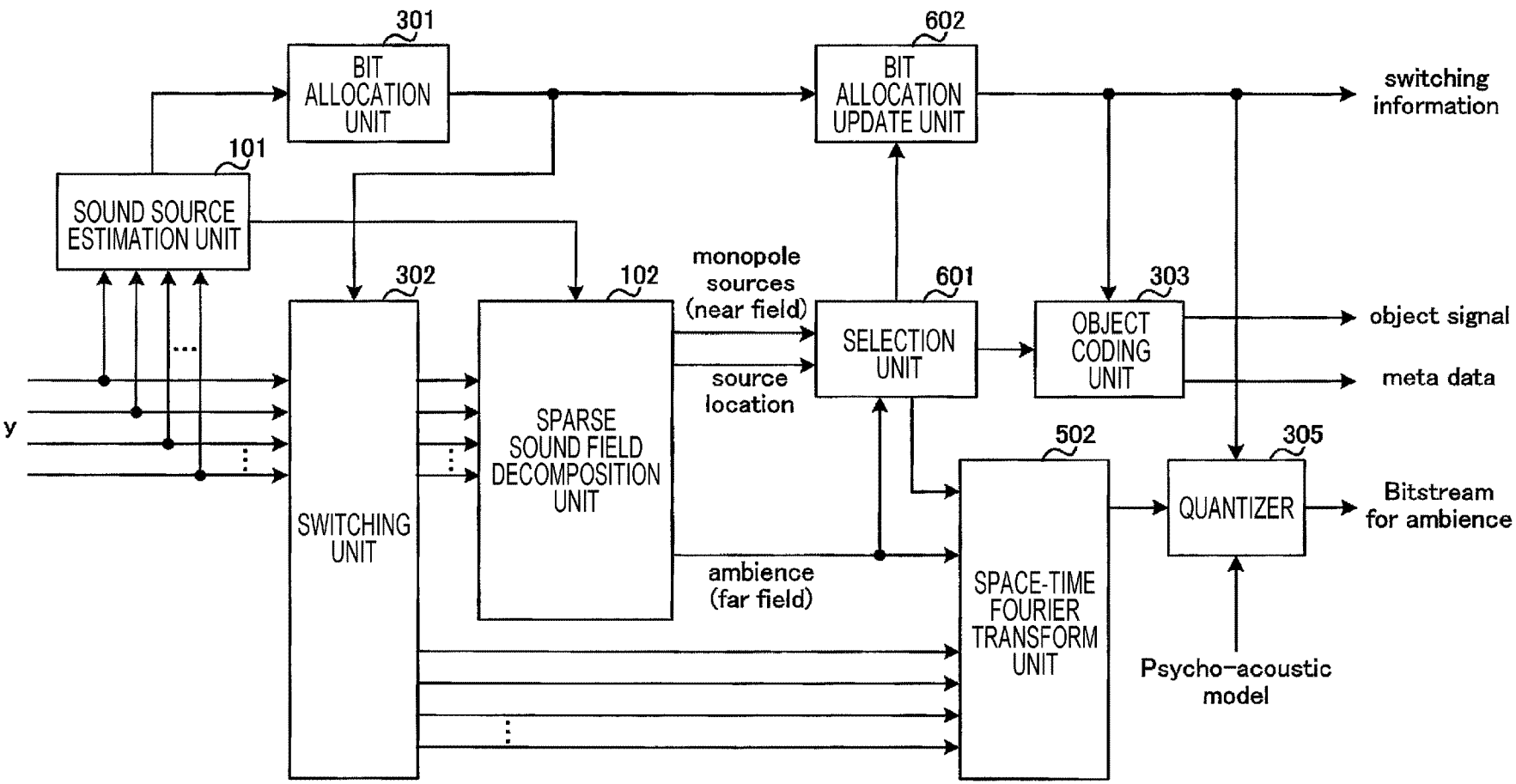
FIG. 12 is a block diagram that illustrates a configuration example of a coding apparatus according to method 1 of a fourth embodiment.

FIG. 12 is a block diagram that illustrates a configuration of a coding apparatus 600 according to method 1 of this embodiment.

Note that in FIG. 12, the same reference numerals are given to similar configurations to the second embodiment (FIG. 9) or the third embodiment (FIG. 11), and descriptions thereof will not be made. Specifically, the coding apparatus 600 illustrated in FIG. 12 additionally includes a selection unit 601 and a bit allocation update unit 602 compared to the configuration of the second embodiment (FIG. 9).

Similarly to the selection unit 501 (FIG. 11) of the third embodiment, the selection unit 601 selects main sound sources (for example, a prescribed number of sound sources in descending order of energy), which are a portion of the sound source signals x input from the sparse sound field decomposition unit 102. Here, the selection unit 601 calculates the energy of the ambient noise signal h input from the sparse sound field decomposition unit 102. In a case where the energy of the ambient noise signal is a prescribed threshold value or lower, the selection unit 601 outputs more sound source signals x as the main sound sources to the object coding unit 303 than a case where the energy of the ambient noise signal exceeds the prescribed threshold value. The selection unit 601 outputs information that indicates increase or decrease in the bit allocations to the bit allocation update unit 602 in accordance with the selection result of the sound source signals x.

The bit allocation update unit 602 determines the allocations of the number of bits assigned to the sound source signals coded by the object coding unit 303 and the number of bits assigned to the ambient noise signal quantized in the quantizer 305, based on the information input from the selection unit 601. That is, the bit allocation update unit 602 updates the switching information (bit allocation information) of the bit allocation unit 301.

The bit allocation update unit 602 outputs the switching information that indicates the updated bit allocations to the object coding unit 303 and the quantizer 305. Further, the switching information is transmitted to the decoding apparatus 400 (FIG. 10) while being multiplexed with the object-coding bitstream and the ambient-noise-coding bitstream (not illustrated).

The object coding unit 303 and the quantizer 305 respectively perform coding or quantization for the sound source signals x or the ambient noise signal h in accordance with the bit allocations indicated by the switching information input from the bit allocation update unit 602.

Note that coding may not be performed at all for the ambient noise signal with low energy, whose bit allocation is decreased, and may be generated as a pseudo ambient noise at a prescribed threshold value level on the decoding side. Alternatively, for the ambient noise signal with low energy, the energy information may be coded and sent. In this case, although a bit allocation is requested for the ambient noise signal, a small bit allocation is sufficient for only the energy information compared to a case where the ambient noise signal h is included.

[Method 2]

In method 2, a description will be made about examples of a coding apparatus that has a configuration which codes and sends the energy information of the ambient noise signal as described above and a decoding apparatus.

[Configuration of Coding Apparatus]

Figure 13:
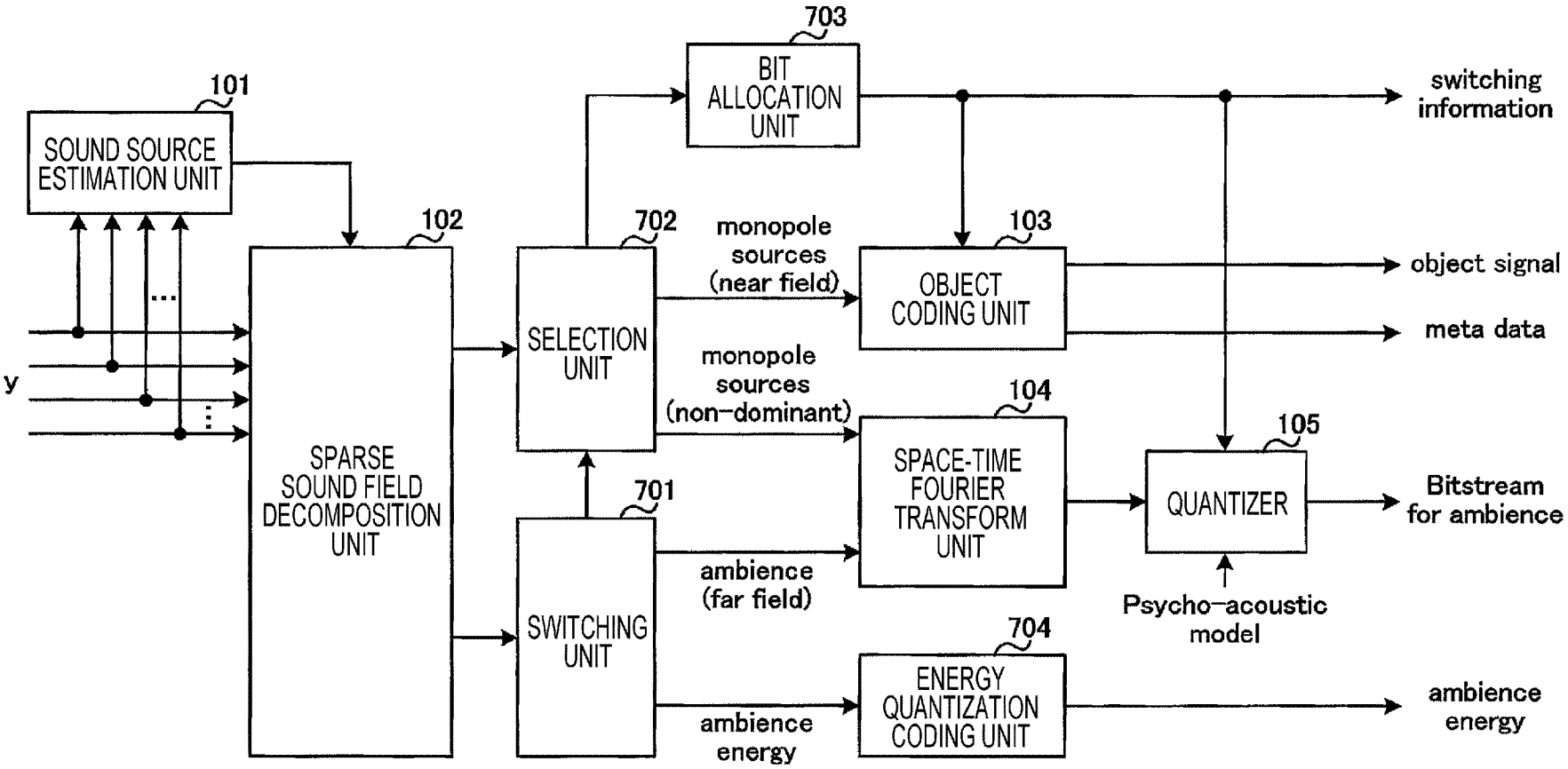
FIG. 13 is a block diagram that illustrates a configuration example of a coding apparatus according to method 2 of the fourth embodiment.

FIG. 13 is a block diagram that illustrates a configuration of a coding apparatus 700 according to method 2 of this embodiment.

Note that in FIG. 13, the same reference numerals are given to similar configurations to the first embodiment (FIG. 2), and descriptions thereof will not be made. Specifically, the coding apparatus 700 illustrated in FIG. 13 additionally includes a switching unit 701, a selection unit 702, a bit allocation unit 703, and an energy quantization coding unit 704 compared to the configuration of the first embodiment (FIG. 2).

In the coding apparatus 700, the sound source signal x obtained by the sparse sound field decomposition unit 102 is output to the selection unit 702, and the ambient noise signal h is output to the switching unit 701.

The switching unit 701 calculates the energy of the ambient noise signal input from the sparse sound field decomposition unit 102 and assesses whether or not the calculated energy of the ambient noise signal exceeds a prescribed threshold value. In a case where the energy of the ambient noise signal is the prescribed threshold value or low, the switching unit 701 outputs information (ambience energy) that indicates the energy of the ambient noise signal to the energy quantization coding unit 704. On the other hand, in a case where the energy of the ambient noise signal exceeds the prescribed threshold value, the switching unit 701 outputs the ambient noise signal to the space-time Fourier transform unit 104. Further, the switching unit 701 outputs, to the selection unit 702, information (assessment result) that indicates whether or not the energy of the ambient noise signal exceeds the prescribed threshold value.

The selection unit 702 determines the number of sound sources to be targets of object coding (the number of sound sources to be selected) from the sound source signals (sparse sound sources) input from the sparse sound source separation unit 102 based on the information input from the switching unit 701 (the information that indicates whether or not the energy of the ambient noise signal exceeds the prescribed threshold value). For example, similarly to the selection unit 601 of the coding apparatus 600 according to method 1, the selection unit 702 sets a larger number of sound sources, which are selected as the targets of object coding in a case where the energy of the ambient noise signal is the prescribed threshold value or lower, than the number of sound sources, which are selected as the target of object coding in a case where the energy of the ambient noise signal exceeds the prescribed threshold value.

Then, the selection unit 702 selects and outputs the determined number of sound source components to the object coding unit 103. Here, the selection unit 702 may select sound sources in order from main sound sources, for example (a prescribed number of sound sources in descending order of energy, for example). Further, the selection unit 702 outputs the remaining sound source signals that are not selected (monopole sources (non-dominant)) to the space-time Fourier transform unit 104.

Further, the selection unit 702 outputs the determined number of sound sources and the information input from the switching unit 701 to the bit allocation unit 703.

The bit allocation unit 703 sets the allocations of the number of bits assigned to the sound source signals coded by the object coding unit 103 and the number of bits assigned to the ambient noise signal quantized in the quantizer 105, based on the information input from the selection unit 702. The bit allocation unit 703 outputs the switching information that indicates the bit allocations to the object coding unit 103 and the quantizer 105. Further, the switching information is transmitted to a decoding apparatus 800 (FIG. 14), which will be described later, while being multiplexed with the object-coding bitstream and the ambient-noise-coding bitstream (not illustrated).

The energy quantization coding unit 704 performs quantization coding of ambient noise energy information input from the switching unit 701 and outputs coding information (ambience energy). The coding information is transmitted as an ambient-noise-energy-coding bitstream to the decoding apparatus 800 (FIG. 14), which will be described later, while being multiplexed with the object-coding bitstream, the ambient-noise-coding bitstream, and the switching information (not illustrated).

Note that in a case where ambient noise energy is a prescribed threshold value or low, the coding apparatus 700 may not code the ambient noise signal but may additionally perform object coding of the sound source signals in an allowable range of the bit rate.

Further, in addition to the configuration illustrated in FIG. 13, the coding apparatus according to method 2 may include a configuration which switches the sparse sound field decomposition and another coding model in accordance with the number of sound sources estimated by the sound source estimation unit 101 as described in the second embodiment (FIG. 9). Alternatively, the coding apparatus according to method 2 may not include the configuration of the sound source estimation unit 101 illustrated in FIG. 13.

Further, the coding apparatus 700 may calculate the average value of the energy of all channels as the energy of the above-described ambient noise signal or may use other methods. As other methods, a method in which information of an individual channel is used as the energy of the ambient noise signal, a method in which all the channels are divided into sub-groups and the average energy of each sub-group is obtained, or the like may be raised. Here, the coding apparatus 700 may perform an assessment about whether or not the energy of the ambient noise signal exceeds a threshold value by using the average value of all the channels or may perform the assessment by using the maximum value among the pieces of energy of the ambient noise signals that are obtained for respective channels or sub-groups in cases where the other methods are used. Further, as the quantization coding of the energy, the coding apparatus 700 may apply scalar quantization in a case where the average energy of all the channels is used and may apply scalar quantization or vector quantization in a case where plural pieces of energy are coded. Further, in order to improve the efficiency of quantization and coding, predictive quantization that uses inter-frame correlation is also effective.

[Configuration of Decoding Apparatus]

Figure 14:
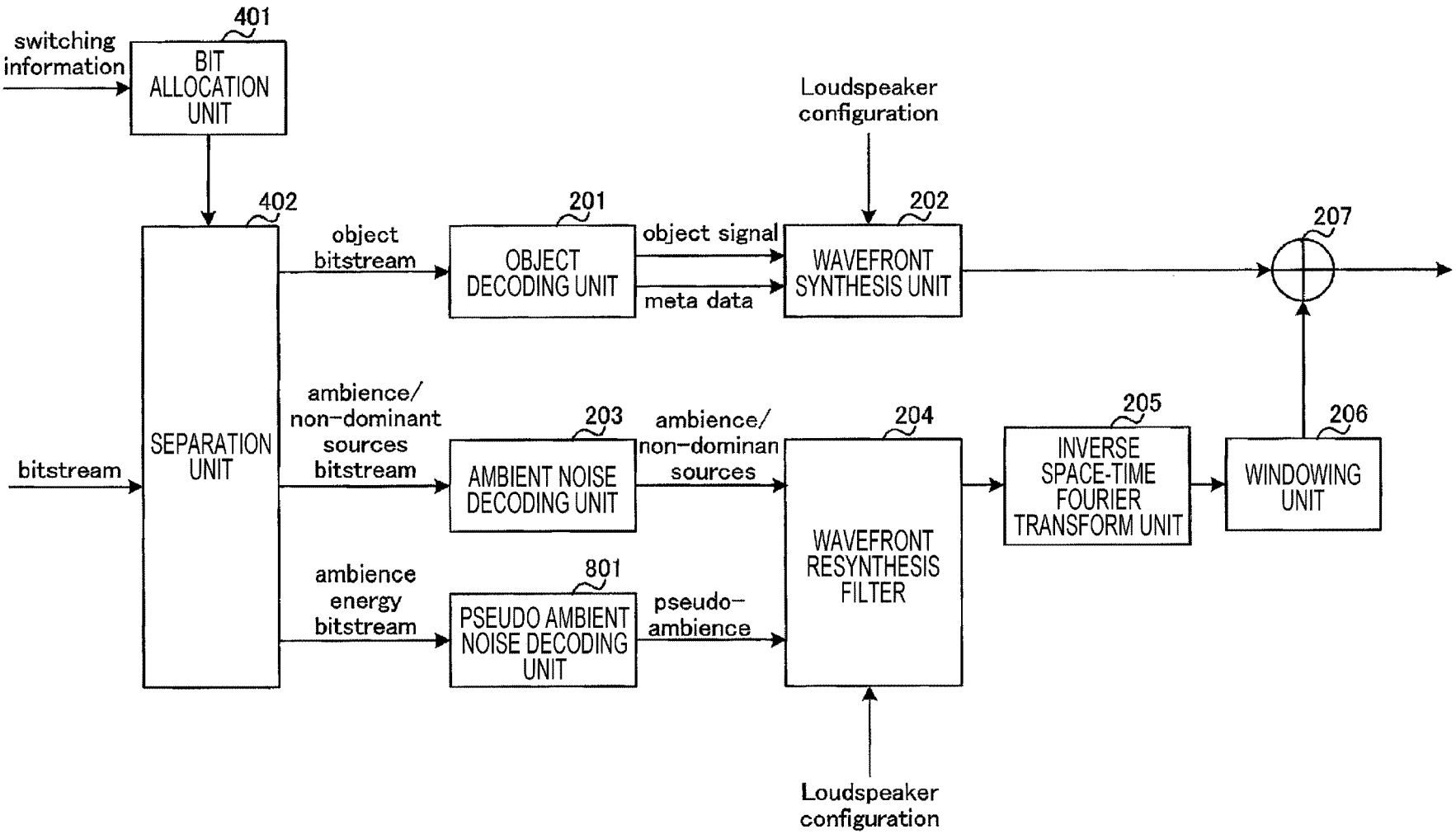
FIG. 14 is a block diagram that illustrates a configuration example of a decoding apparatus according to method 2 of the fourth embodiment.

FIG. 14 is a block diagram that illustrates a configuration of the decoding apparatus 800 according to method 2 of this embodiment.

Note that in FIG. 14, the same reference numerals are given to similar configurations to the first embodiment (FIG. 3) or the second embodiment (FIG. 10), and descriptions thereof will not be made. Specifically, the decoding apparatus 800 illustrated in FIG. 14 additionally includes a pseudo ambient noise decoding unit 801 compared to the configuration of the second embodiment (FIG. 10).

The pseudo ambient noise decoding unit 801 uses the ambient-noise-energy-coding bitstream input from the separation unit 402 and a pseudo ambient noise source that is separately retained by the decoding apparatus 800, thereby decodes a pseudo ambient noise signal, and outputs it to the wavefield resynthesis filter 204.

Note that if the pseudo ambient noise decoding unit 801 incorporates a process in consideration of transform from a microphone array of the coding apparatus 700 into a speaker array of the decoding apparatus 800, it is possible to provide a decoding process in which an output to the inverse space-time Fourier transform unit 205 is performed while an output to the wavefield resynthesis filter 204 is skipped.

In the above, method 1 and method 2 are described.

In such a manner, in this embodiment, in a case where the energy of the ambient noise signal is low, the coding apparatuses 600 and 700 perform object coding by reallocating as many bits as possible to coding of the sound source signal components rather than coding of the ambient noise signal. Accordingly, the coding performance in the coding apparatuses 600 and 700 may be improved.

Further, in this embodiment, the coding information of the energy of the ambient noise signal extracted by the sparse sound field decomposition unit 102 of the coding apparatus 700 is transmitted to the decoding apparatus 800. The decoding apparatus 800 generates the pseudo ambient noise signal based on the energy of the ambient noise signal. Accordingly, in a case where the energy of the ambient noise signal is low, the energy information which requests a small bit allocation is coded instead of the ambient noise signal. Consequently, more bits may be allocated to the sound source signals, and the acoustic signal may thus be coded efficiently.

In the foregoing, the embodiments of the present disclosure are described.

Note that the present disclosure can be realized by software, hardware, or software in cooperation with hardware. Each functional block used in the description of each embodiment described above can be partly or entirely realized by an LSI such as an integrated circuit, and each process described in each embodiment described above may be controlled partly or entirely by the same LSI or a combination of LSIs. The LSI may be individually formed as chips, or one chip may be formed so as to include a part or all of the functional blocks. The LSI may include data input and output. The LSI here may be referred to as an IC, a system LSI, a super LSI, or an ultra LSI depending on a difference in the degree of integration. The technique of implementing an integrated circuit is not limited to the LSI and may be realized by using a dedicated circuit, a general-purpose processor, or a special-purpose processor. Further, a FPGA (field programmable gate array) that can be programmed after the manufacture of the LSI or a reconfigurable processor in which the connections and the settings of circuit cells disposed inside the LSI can be reconfigured may be used. The present disclosure can be realized as digital processing or analogue processing. In addition, if integrated circuit technology replaces LSIs as a result of the advancement of semiconductor technology or other derivative technology, the functional blocks may be integrated using such technology. Biotechnology can also be applied.

A coding apparatus of the present disclosure includes: an estimation circuit that estimates, in a space as a target of sparse sound field decomposition, an area where a sound source is present at second granularity which is coarser than first granularity of a position where a sound source is assumed to be present in the sparse sound field decomposition; and a decomposition circuit that decomposes an acoustic signal observed by a microphone array into a sound source signal and an ambient noise signal by performing the sparse sound field decomposition process at the first granularity for the acoustic signal in the area at the second granularity where the sound source is estimated to be present in the space.

In the coding apparatus of the present disclosure, the decomposition circuit performs the sparse sound field decomposition process in a case where the number of areas where the sound source is estimated to be present by the estimation circuit is a first threshold value or less and does not perform the sparse sound field decomposition process in a case where the number of areas exceeds the first threshold value.

The coding apparatus of the present disclosure further includes: a first coding circuit that codes the sound source signal in a case where the number of areas is the first threshold value or less; and a second coding circuit that codes the ambient noise signal in a case where the number of areas is the first threshold value or less and codes the acoustic signal in a case where the number of areas exceeds the first threshold value.

The coding apparatus of the present disclosure further includes a selection circuit that outputs a portion of sound source signals generated by the decomposition circuit as object signals and outputs a remainder of the sound source signals generated by the decomposition circuit as the ambient noise signal.

In the coding apparatus of the present disclosure, the number of portion of the sound source signals that are selected in a case where energy of the ambient noise signal generated by the decomposition circuit is a second threshold value or lower is greater than the number of portion of the sound source signals that are selected in a case where the energy of the ambient noise signal exceeds the second threshold value.

The coding apparatus of the present disclosure further includes a quantization coding circuit that performs quantization coding of information which indicates the energy in a case where the energy is the second threshold value or lower.

A coding method of the present disclosure includes: estimating, in a space as a target of sparse sound field decomposition, an area where a sound source is present at second granularity that is coarser than first granularity of a position where a sound source is assumed to be present in the sparse sound field decomposition; and decomposing an acoustic signal observed by a microphone array into a sound source signal and an ambient noise signal by performing the sparse sound field decomposition process at the first granularity for the acoustic signal in the area at the second granularity where the sound source is estimated to be present in the space.

INDUSTRIAL APPLICABILITY

One aspect of the present disclosure is useful for voice communication systems.

REFERENCE SIGNS LIST

100, 300, 500, 600, 700 coding apparatus
101 sound source estimation unit
102 sparse sound field decomposition unit
103, 303 object coding unit
104, 304, 502 space-time Fourier transform unit
105, 305 quantizer
200, 400, 800 decoding apparatus
201 object decoding unit
202 wavefield synthesis unit
203 ambient noise decoding unit
204 wavefied resynthesis filter
205 inverse space-time Fourier transform unit
206 windowing unit
207 adder
301, 401, 703 bit allocation unit
302, 701 switching unit
402 separation unit
501, 601, 702 selection unit
602 bit allocation update unit
704 energy quantization coding unit
801 pseudo ambient noise decoding unit

The invention claimed is:

1. A coding apparatus comprising:

an estimation circuit that estimates, in a space as a target of sparse sound field decomposition, an area where a sound source is present at second granularity which is coarser than first granularity of a position where a sound source is assumed to be present in the sparse sound field decomposition; and a decomposition circuit that decomposes an acoustic signal observed by a microphone array into a sound source signal and an ambient noise signal by performing the sparse sound field decomposition process at the first granularity for the acoustic signal in the area at the second granularity where the sound source is estimated to be present in the space.

2. The coding apparatus according to claim 1, wherein the decomposition circuit performs the sparse sound field decomposition process in a case where the number of areas where the sound source is estimated to be present by the estimation circuit is a first threshold value or less and does not perform the sparse sound field decomposition process in a case where the number of areas exceeds the first threshold value.

3. The coding apparatus according to claim 2, further comprising:

a first coding circuit that codes the sound source signal in a case where the number of areas is the first threshold value or less; and a second coding circuit that codes the ambient noise signal in a case where the number of areas is the first threshold value or less and codes the acoustic signal in a case where the number of areas exceeds the first threshold value.

4. The coding apparatus according to claim 1, further comprising:

a selection circuit that outputs a portion of sound source signals generated by the decomposition circuit as object signals and outputs a remainder of the sound source signals generated by the decomposition circuit as the ambient noise signal.

5. The coding apparatus according to claim 4, wherein the number of portion of the sound source signals that are selected in a case where energy of the ambient noise signal generated by the decomposition circuit is a second threshold value or lower is greater than the number of portion of the sound source signals that are selected in a case where the energy of the ambient noise signal exceeds the second threshold value.

6. The coding apparatus according to claim 5, further comprising:

a quantization coding circuit that performs quantization coding of information which indicates the energy in a case where the energy is the second threshold value or lower.

7. A coding method comprising:

estimating, in a space as a target of sparse sound field decomposition, an area where a sound source is present at second granularity that is coarser than first granularity of a position where a sound source is assumed to be present in the sparse sound field decomposition; and decomposing an acoustic signal observed by a microphone array into a sound source signal and an ambient noise signal by performing the sparse sound field decomposition process at the first granularity for the acoustic signal in the area at the second granularity where the sound source is estimated to be present in the space.

* * * * *